US009536727B2

(12) United States Patent
Satoh

(10) Patent No.: US 9,536,727 B2
(45) Date of Patent: Jan. 3, 2017

(54) TIME-OF-FLIGHT MASS SPECTROMETER AND METHOD OF CONTROLLING SAME

(71) Applicant: JEOL Ltd., Tokyo (JP)

(72) Inventor: Takaya Satoh, Tokyo (JP)

(73) Assignee: JEOL Ltd., Tokyo (JP)

( * ) Notice: Subject to any disclaimer, the term of this patent is extended or adjusted under 35 U.S.C. 154(b) by 112 days.

(21) Appl. No.: 14/025,207

(22) Filed: Sep. 12, 2013

(65) Prior Publication Data

US 2014/0077076 A1 Mar. 20, 2014

(30) Foreign Application Priority Data

Sep. 14, 2012 (JP) ..... 2012-202792

(51) Int. Cl.
*H01J 49/00* (2006.01)
*H01J 49/40* (2006.01)

(52) U.S. Cl.
CPC ..... *H01J 49/403* (2013.01); *H01J 49/005* (2013.01); *H01J 49/0031* (2013.01); *H01J 49/40* (2013.01)

(58) Field of Classification Search
CPC ..... H01J 49/427; H01J 49/428; H01J 49/429
See application file for complete search history.

(56) References Cited

U.S. PATENT DOCUMENTS 6,057,544 A * 5/2000 Ishihara ..... H01J 49/40 250/281
2002/0027194 A1* 3/2002 Holle ..... H01J 49/40 250/287
2003/0071211 A1* 4/2003 Kawato ..... H01J 49/429 250/300
2004/0232327 A1* 11/2004 Bateman et al. ..... 250/288
(Continued)

FOREIGN PATENT DOCUMENTS

GB 2080021 A 1/1982
JP 2000243345 A 9/2000
(Continued)

OTHER PUBLICATIONS

M. Toyoda et al., "Multi-turn time-of-flight mass spectrometers with electrostatic sectors", Journal of Mass Spectrometry, 2003, pp. 1125-1142, vol. 38.
(Continued)

*Primary Examiner* — Nicole Ippolito
*Assistant Examiner* — James Choi
(74) *Attorney, Agent, or Firm* — The Webb Law Firm

(57) ABSTRACT

A flight-of-time mass spectrometer is offered which can provide a variable range of collisional energies that can be made wider than heretofore. Also, a method of controlling this spectrometer is offered. The spectrometer has an ion source, a first mass analyzer, an ion gate, a potential lift, a collisional cell, a second mass analyzer, a detector, and a potential control portion for controlling the potential on the
(Continued)

potential lift. When the precursor ions selected by the ion gate enter the potential lift, the potential control portion sets the potential on the conductive box at $V_1$. When the potential on the potential lift is varied, the potential control portion varies the potential on the potential lift from $V_1$ to $V_2$ while precursor ions are traveling through the potential lift.

9 Claims, 6 Drawing Sheets

(56) References Cited

U.S. PATENT DOCUMENTS

2005/0199804 A1* 9/2005 Hunt ..... G01N 33/6848 250/290
2007/0029473 A1* 2/2007 Verentchikov ..... 250/281
2011/0174967 A1* 7/2011 Kou ..... H01J 49/0031 250/287
2012/0145889 A1* 6/2012 Vestal ..... H01J 49/403 250/282
2013/0168547 A1* 7/2013 Nishiguchi ..... H01J 49/405 250/287
2013/0221216 A1* 8/2013 Makarov et al. ..... 250/282
2013/0306859 A1* 11/2013 Satoh ..... H01J 49/0031 250/283
2014/0284471 A1* 9/2014 Brown ..... H01J 49/06 250/282

FOREIGN PATENT DOCUMENTS

JP 200386129 A 3/2003
JP 200612782 A 1/2006
WO 2005001878 A2 1/2005

OTHER PUBLICATIONS

E. Pittenauer et al., "High-Energy Collision Induced Dissociation of Biomolecules: MALDI-TOF/RTOF Mass Spectrometry in Comparison to Tandem Sector Mass Spectrometry", Combinatorial Chemistry & High Throughput Screening, 2009, pp. 137-155, vol. 12, Benthan Science Publishers Ltd.

* cited by examiner

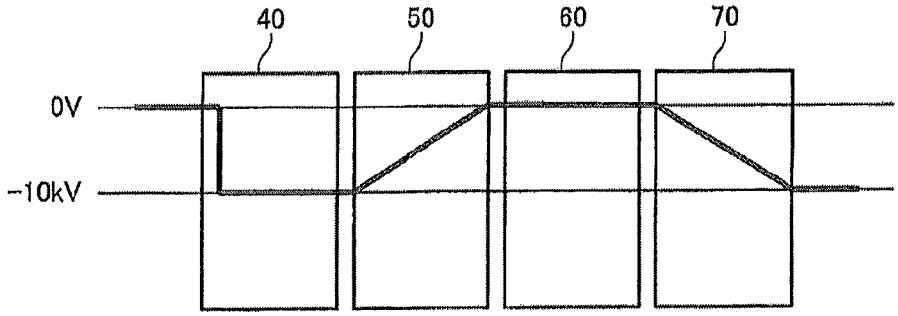
Fig. 5(a)
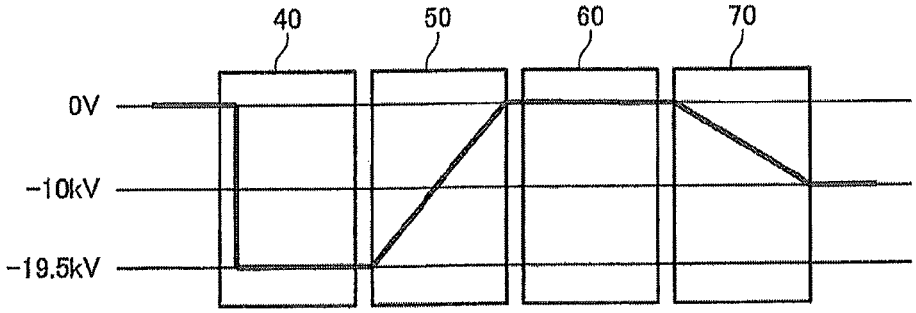
Fig. 5(b)
| valence number of precursor ions | variable range of potentials on the potential lift | decelerating potential difference | maximum collisional kinetic energy (converted into monovalence) |
|---|---|---|---|
| 2 | -10kV~-20kV | 10kV~20kV | 0~10keV |
| 3 | -13.33kV~-20kV | 13.33kV~20kV | 0~6.67keV |
| 4 | -15kV~-20kV | 15kV~20kV | 0~5keV |
Fig. 6

| apparatus | #1 | #2 | #3 | #4 |
|---|---|---|---|---|
| acceleration voltage (kV) | 20 | 8 | 8 | 20 |
| deceleration voltage (kV) | | 5~7.5 | | |
| collisional energy (keV) | 20 | 0.5~3 | 8 | 20 |
| reacceleration voltage (kV) | | 15 | 19 | 9 |
| kinetic energy of product ion (keV) | 0~20 | 15~18 | 19~27 | 9~29 |
| requisite acceptance (%) | 0~100 | 83~100 | 70~100 | 31~100 |
| type of reflectron field of second TOFMS | Curved field reflectron | Single stage reflectron | Dual stage reflectron | Offset palaboric reflectron |
| | parabolic field | linear field | linear field | linear field + parabolic field |

Fig. 8

| $z_1$ | $z_p$ | $z_1/z_p$ | m/M values capable of satisfying the relation $z_1/z_p \times m/M \leq 1$ |
|---|---|---|---|
| 2 | 2 | 1 | 0~1 |
| | 1 | 2 | 0~0.5 |
| 3 | 3 | 1 | 0~1 |
| | 2 | 1.5 | 0~0.67 |
| | 1 | 3 | 0~0.33 |
| 4 | 4 | 1 | 0~1 |
| | 3 | 1.33 | 0~0.75 |
| | 2 | 2 | 0~0.5 |
| | 1 | 4 | 0~0.25 |

Fig. 9

TIME-OF-FLIGHT MASS SPECTROMETER AND METHOD OF CONTROLLING SAME

CROSS-REFERENCE TO RELATED APPLICATIONS

This application claims priority to Japanese Patent Application No. 2012-202792, filed Sep. 14, 2012, the disclosure of which is hereby incorporated in its entirety by reference.

BACKGROUND OF THE INVENTION

Field of the Invention

The present invention relates to a time-of-flight mass spectrometer used in quantitative analysis and simultaneous qualitative analysis of trace compounds and also in structural analysis of sample ions. The invention also relates to a method of controlling this spectrometer.

Description of the Related Art

A mass spectrometer (MS) ionizes a sample in an ion source, separates the resulting ions in a mass analyzer at each value of m/z obtained by dividing the mass (m) by the charge number (z), and detects the separated ions by a detector. The results are represented in the form of a mass spectrum. On the horizontal axis of the spectrum, m/z values are plotted, while on the vertical axis, relative intensities are plotted. In this way, m/z values and relative intensities of compounds contained in the sample are obtained. Consequently, qualitative and quantitative information about the sample can be derived. Various methods are available as ionization method, mass separation method, and ion detection method for mass spectrometers.

A time-of-flight (TOF) mass spectrometer is an instrument that finds the mass-to-charge ratio (m/z) of each ion by accelerating ions with a given accelerating voltage, causing them to fly, and calculating the m/z from the time taken for each ion to reach a detector. In the TOF mass spectrometer, ions are accelerated by a constant pulsed voltage $V_a$. At this time, from the law of conservation of energy, the following Eq. (1) holds.

$$\frac{mv^2}{2} = zeV_a \tag{1}$$

where v is the velocity of the ion, m is the mass of the ion, z is the valence number of the ion, and e is the elementary charge.

From Eq. (1), the velocity v of the ion is given by $$v = \sqrt{\frac{2zeV_a}{m}} \tag{2}$$

Therefore, the flight time T required for the ion to reach a detector, placed behind at a given distance of L, is given by $$T = \frac{L}{v} = L\sqrt{\frac{m}{2zeV_a}} \tag{3}$$

As can be seen from Eq. (3), the flight time T differs according to m/z of each ion. TOFMS is an instrument for separating ions employing this principle.

A linear TOF mass spectrometer in which ions are made to fly linearly from an ion source to a detector and a reflectron TOF mass spectrometer in which a reflectron field is placed between an ion source and a detector to improve energy focusing and to prolong the flight distance have enjoyed wide acceptance. It is known that reflectron TOF mass spectrometers are used to estimate the compositions of unknown substances, because they can measure the m/z values of unknown substances with errors on the order of ppm with respect to m/z values computationally found from composition formulas.

The mass resolution R of a TOF mass spectrometer is defined as follows:

$$R = \frac{T}{2\Delta T} \tag{4}$$

where T is the total flight time and ΔT is a peak width.

That is, if the peak width ΔT is made constant and the total flight time T can be lengthened, the mass resolution can be improved. However, in the related art linear or reflectron type TOFMS, increasing the total flight time T (i.e., increasing the total flight distance) will lead directly to an increase in instrumental size. A multi-pass time-of-flight mass spectrometer has been developed to realize high mass resolution while avoiding an increase in instrumental size (non-patent document 1). This instrument uses four toroidal electric fields each consisting of a combination of a cylindrical electric field and a Matsuda plate. The total flight time T can be lengthened by accomplishing multiple turns in an 8-shaped circulating orbit. In this apparatus, the spatial and temporal spread at the detection surface has been successfully converged up to the first-order term using the initial position, initial angle, and initial kinetic energy.

However, the TOFMS in which ions revolve many times in a closed trajectory suffers from the problem of "overtaking". That is, because ions revolve multiple times in a closed trajectory, lighter ions moving at higher speeds overtake heavier ions moving at smaller speeds. Consequently, the fundamental concept of TOFMS that ions arrive at the detection surface in turn first from the lightest one does not hold.

The spiral-trajectory TOFMS has been devised to solve this problem. The spiral-trajectory TOFMS is characterized in that the starting and ending points of a closed trajectory are shifted from the closed trajectory plane in the vertical direction. To achieve this, in one method, ions are made to impinge obliquely from the beginning (patent document 1). In another method, the starting and ending points of the closed trajectory are shifted in the vertical direction using a deflector (patent document 2). In a further method, laminated toroidal electric fields are used (patent document 3).

Another TOFMS has been devised which is based on a similar concept but in which the trajectory of the multi-pass TOF-MS (patent document 4) where overtaking occurs is zigzagged (patent document 5).

As described previously, in a mass spectrometer, ions generated in an ion source are separated according to m/z value in a mass analyzer and detected. The results are expressed in the form of a mass spectrum in which the m/z values of ions and their relative intensities are graphed. This measurement may hereinafter be referred to as an MS measurement in contrast with an MS/MS measurement. In the MS/MS measurement, certain ions generated in an ion source are selected by a first stage of mass analyzer (hereinafter referred to as MS1). The selected ions are referred to precursor ions. These ions spontaneously fragment or are caused to fragment, and the generated, fragmented ions (referred to as product ions) are mass analyzed by a subsequent stage of mass analyzer (referred to as MS2). An instrument enabling this is referred to as an MS/MS instrument. In MS/MS measurements, the m/z values of precursor ions, the m/z values of product ions generated in plural fragmentation paths, and information about relative intensities are obtained and so structural information about the precursor ions can be obtained. Various types of MS/MS instrument exist which can perform MS/MS measurements and in which two of the aforementioned mass spectrometers are combined. Furthermore, various fragmentation methods exist such as collision induced dissociation (CID) using collision with gas, photodissociation, and electron capture dissociation.

Dissociation information about an MS/MS instrument utilizing CID differs according to collisional energy, i.e., the magnitude of kinetic energy of ions impinging on a collisional cell. In the case of currently available MS/MS instruments, CIDs are classified into two types: CIDs of low energies on the order of tens of eV and CIDs of high energies from several kV to tens of keV. The difference depends on the configuration of the instrument. High-energy CID has the advantage that, when a peptide having tens of amino acids chained together is fragmented, side chain information may be obtained. It is possible to distinguish between leucine and isoleucine having the same molecular weight.

CITATION LIST

Patent Documents

Patent document 1: JP-A-2000-243345
Patent document 2: JP-A-2003-86129
Patent document 3: JP-A-2006-12782
Patent document 4: GB2080021
Patent document 5: WO2005/001878

Non-Patent Documents

Non-patent document 1: M. Toyoda, D. Okumura, M. Ishihara and I. Katakuse, *J. Mass Spectrom.,* 2003, 38, pp. 1125-1142.

Non-patent document 2: E. Pittenauer and G. Allmaier, Combinatorial Chemistry & High Throughput Screening, 2009, 12, pp. 137-155

An MS/MS instrument in which two TOF mass spectrometers are connected in tandem is generally referred to as a TOF/TOF. This is mainly used in an instrument which ionizes samples by matrix assisted laser desorption/ionization (MALDI). A conventional TOF/TOF is composed of a linear type first TOF mass spectrometer and a reflectron type second TOF mass spectrometer (see FIG. 7). An ion gate for selecting precursor ions is positioned between the first TOF mass spectrometer and the second TOF mass spectrometer. The focal point of the first TOF mass spectrometer is placed near the ion gate.

Precursor ions fragment spontaneously or forced to fragment either in the first TOF mass spectrometer or in a collisional cell placed ahead of the reflectron field of the second TOF mass spectrometer. The kinetic energy, $eU_P$, per valence, of product ions generated by fragmentation is given by $$eU_p = eU_i \times \frac{z_i}{z_p} \times \frac{m}{M} \tag{5}$$

where $z_p$ and $z_i$ are the valence numbers of product ions and precursor ions, respectively, $eU_i$ is the kinetic energy per valence of precursor ions, m is the mass of each product ion, and M is the mass of each precursor ion. Precursor ions generated by a MALDI ion source are substantially monovalent. Product ions are also monovalent. Note that neutral molecules cannot be observed by a mass spectrometer. Therefore, Eq. (5) can be rewritten as follows:

$$eU_p = eU_i \times \frac{m}{M} \tag{6}$$

Eq. (6) shows that the kinetic energy of product ions is always smaller than that of precursor ions.

In TOF/TOF, the acceptance in the reflectron field in the second TOF mass spectrometer is an important factor. The acceptance is the kinetic energy per valence number capable of being measured by the second TOF mass spectrometer including the reflectron field. In the case of fragmentation of monovalent ions, ions having the highest kinetic energy are precursor ions and so the acceptance that the second TOF mass spectrometer is required to have varies depending on the kinetic energy of the smallest product ion when the kinetic energy of the precursor ions is set to 100%. Today, there are four major types of TOF/TOF optical system (see the table of FIG. 8 and non-patent document 2). However, available methods are classified into two major methods. In one method, precursor and product ions are reaccelerated, and the second TOF mass spectrometer having a linear field of small acceptance is used (#2 and #3 of FIG. 8). In another method, no reacceleration is done or a reacceleration is done to such an extent that a kinetic energy smaller than the kinetic energy of precursor ions is given, and the reflectron field including a curved field of large acceptance is used (#1 and #4 of FIG. 8). As can be seen from the table of FIG. 8, however, in any method, it is impossible to greatly vary the collisional energy that affects the fragmentation greatly.

It is known that ions generated by a MALDI process fragment spontaneously. This is referred to as Post Source Decay (PSD). Their fragmentation pathways are observed by MALDI-TOF/TOF, and it is said that they resemble those of CID of relatively low energies. That is, in MALDI-TOF/TOF, it is theoretically possible to observe fragmentation pathways of CID of high energies. Fragmentation pathways of PSD similar to fragmentation pathways of low-energy CID are also observed. This complicates the resulting spectrum.

Where precursor ions are multivalent, the circumstances are greatly different from those of monovalent precursor ions. Prevailing ion sources for generating multivalent ions are electrospray ionization (ESI) ion sources. Today, combinations with TOF/TOF do not exist except for experimental equipment, for the following reason. Where the accelerating potential difference in the first TOF mass spectrometer is constant, the kinetic energy of precursor ions is in proportion to the valence number. For example, in the case of an accelerating potential difference of 20 kV, a monovalent ion has a kinetic energy of 20 keV. A bivalent ion has a kinetic energy of 40 keV. However, a force that an ion experiences in a reflectron field is also in proportion to the valence number. Therefore, where only precursor ions not fragmented are measured, i.e., a mass spectrum is measured, it is only necessary to establish in the reflectron field a potential difference that pushes back ions of the kinetic energy per valence given by the accelerating potential difference. However, where fragmentations occur and the valence number of product ions is smaller than that of precursor ions, the circumstances are different.

A slight modification of Eq. (5) results in $$\frac{eU_p}{eU_i} = \frac{z_i}{z_p} \times \frac{m}{M} \tag{7}$$

The left-hand side of Eq. (7) is obtained by dividing the kinetic energy per valence of product ions by the kinetic energy given to one valence of precursor ions. m/M is smaller than unity at all times. The valence numbers of product ions may be smaller than those of precursor ions. In some cases, therefore, $z_i/z_p$ is equal to or greater than 1. As a result, in the case where $z_i/z_p \times m/M > 1$, the kinetic energy per valence is greater than the kinetic energy given by the accelerating potential difference. That is, ions cannot be pushed back by a potential difference that is just large enough to push back ions of the kinetic energy per valence given by the accelerating potential difference. FIG. 9 summarizes various m/M values capable of satisfying the relation $z_i/z_p \times m/M \geq 1$ according to the valence numbers of precursor and product ions. It can be seen from FIG. 9 that where product ions are smaller in valence number than precursor ions, some of the product ions cannot be pushed back by the reflectron field and thus cannot be observed. For example, where a bivalent ion having a mass of 1000 u and accelerated by an accelerating potential difference of 20 kV fragments into a monovalent ion having a mass of 600 u and a monovalent ion having a mass of 400 u, product ions of masses of 600 u and 400 u have kinetic energies of 24 keV and 16 keV, respectively. In this case, the ion having the mass of 600 u passes through a reflectron field that is assumed to push back ions accelerated with 20 kV. For this reason, fragmentation of multivalent ions may not be observed efficiently. This is one reason why TOF/TOF is currently not often interfaced with an ion source (such as an ESI ion source) producing multivalent ions.

SUMMARY OF THE INVENTION

In view of the problems described so far, the present invention has been made. According to some embodiments of the present invention, a TOF mass spectrometer can be offered in which the variable range of collisional energies can be made wider than conventional. Also, a method of controlling this TOF mass spectrometer can be offered. Furthermore, according to some embodiments of the invention, a TOF mass spectrometer capable of efficiently observing fragmentations of multivalent ions and a method of controlling this mass spectrometer can be offered.

(1) A time-of-flight (TOF) mass spectrometer associated with the present invention has: an ion source for ionizing a sample to thereby produce ions; a first mass analyzer for separating the produced ions according to flight time corresponding to mass-to-charge ratio; an ion gate for selecting precursor ions from ions separated and selected by the first mass analyzer; a conductive box through which the precursor ions selected by the ion gate pass; a collisional cell for fragmenting the precursor ions passed through the conductive box into product ions; a second mass analyzer for separating the precursor ions passed through the collisional cell and the product ions generated by the collisional cell according to flight time corresponding to mass-to-charge ratio; a detector for detecting ions separated by the second mass analyzer; and a potential control portion for controlling the electric potential on the conductive box. When precursor ions enter the conductive box, the potential control portion sets the potential on the conductive box at a first potential. When the potential on the conductive box is varied, the potential control portion varies the potential on the conductive box from the first potential to a second potential while the precursor ions are passing through the conductive box.

According to this TOF mass spectrometer associated with the present invention, precursor ions exiting from the conductive box possess kinetic energies corresponding to the difference between the second potential and the potential on the collisional cell prior to arrival at the collisional cell. Accordingly, the kinetic energies of the precursor ions on incidence of the collisional cell can be varied greatly according to the set value of the second potential. Hence, the variable range of collisional energies of the precursor ions can be made wider than conventional.

(2) In one feature of this TOF mass spectrometer associated with the present invention, when the potential on the conductive box is varied, the potential control portion may vary the potential from the first potential to the second potential to decelerate the precursor ions before entering the collisional cell by the potential difference between the conductive box and the collisional cell.

According to this TOF mass spectrometer associated with the present invention, precursor ions are decelerated before entering the collisional cell. Therefore, the kinetic energies possessed by the precursor ions on entering the collisional cell are smaller than the kinetic energies possessed by the precursor ions on entering the conductive box. Therefore, the collisional energies of the precursor ions can be varied according to the second potential in a wide range whose upper limit is defined by the kinetic energy of the precursor ions on entering the conductive box.

(3) In a further feature of this TOF mass spectrometer associated with the present invention, the first potential may be the same as the potential on the first mass analyzer.

(4) In a yet other feature of this TOF mass spectrometer associated with the present invention, the potential on the collisional cell may be the same as the potential on the first mass analyzer.

(5) In an additional feature of this TOF mass spectrometer associated with the present invention, the potential control portion may vary a set range of the second potential according to valence numbers of the precursor ions.

(6) In a yet other feature of this TOF mass spectrometer associated with the present invention, the potential control portion may set the second potential within a range in which the difference in absolute value between the second potential and the potential on the collisional cell is between $V_a \times (1-1/z)$ and $V_a$, where z is the valence number of precursor ions and $V_a$ is the accelerating potential difference between the ion source and the first mass analyzer.

According to this TOF mass spectrometer associated with the present invention, the kinetic energies of ions exiting from the collisional cell can be held below the kinetic energies per valence given to the ions by the accelerating potential difference $V_a$. Therefore, if a reflectron field capable of pushing back ions of kinetic energies per valence given by the accelerating potential difference $V_a$ is mounted in the second mass analyzer, all the ions can be pushed back by the reflectron field and reach the detector. As a result, fragmentations of multivalent ions can be efficiently observed, as well as fragmentations of monovalent ions.

(7) In a still other feature of this TOF mass spectrometer associated with the present invention, the second mass analyzer may contain a reflectron field. A maximum kinetic energy per valence of ions capable of being pushed back by the reflectron field may be comparable to the kinetic energy per valence given to ions by the accelerating potential difference between the ion source and the first mass analyzer.

According to this TOF mass spectrometer associated with the present invention, almost all ions having kinetic ions which are less than the kinetic energy per valence given to ions by the accelerating potential difference between the ion source and the first mass analyzer on entering the second mass analyzer can be pushed back by the reflectron field and reach the detector.

(8) In a yet further feature of this TOF mass spectrometer associated with the present invention, a reacceleration portion for reaccelerating ions may be mounted between the collisional cell and the second mass analyzer.

According to this TOF mass spectrometer associated with the present invention, where a reflectron field is produced in the second mass analyzer, for example, if product ions have low kinetic energies, kinetic energy is added to them by the reacceleration portion. Therefore, the product ions can be pushed back by the reflectron field and made to reach the detector.

(9) In an additional feature of this TOF mass spectrometer associated with the present invention, the second mass analyzer may contain a reflectron field. A maximum kinetic energy per valence of ions capable of being pushed back by the reflectron field may be comparable to the sum of the kinetic energy per valence given to ions by the accelerating potential difference between the ion source and the first mass analyzer and the kinetic energy per valence given to ions by reacceleration made by the reacceleration portion.

According to this TOF mass spectrometer associated with the present invention, all of ions having kinetic energies which are less than the kinetic energy per valence given to ions by the accelerating potential difference between the ion source and the first mass analyzer on entering the reacceleration portion can be pushed back by the reflectron field and reach the detector.

(10) In an additional feature of this TOF mass spectrometer associated with the present invention, the reflectron field has a potential distribution that may contain a parabolic portion.

According to this TOF mass spectrometer associated with the present invention, a sufficient length of free space can be secured in the second mass analyzer while maintaining the kinetic energy focusing.

(11) In an additional feature of this TOF mass spectrometer associated with the present invention, the collisional cell and the first mass analyzer may be at ground potential.

(12) Furthermore, the present invention provides a method of controlling a time-of-flight (TOF) mass spectrometer having: an ion source for ionizing a sample to thereby produce ions; a first mass analyzer for separating the produced ions according to flight time corresponding to mass-to-charge ratio; an ion gate for selecting precursor ions from ions separated and selected by the first mass analyzer; a conductive box through which the precursor ions selected by the ion gate pass; a collisional cell for fragmenting the precursor ions passed through the conductive box into product ions; a second mass analyzer for separating the precursor ions passed through the collisional cell and the product ions generated in the collisional cell according to flight time corresponding to mass-to-charge ratio; and a detector for detecting ions separated by the second mass analyzer. The method starts with setting the potential on the conductive box at a first potential when the precursor ions enter the conductive box. When the potential on the conductive box is varied, this potential is varied from the first potential to a second potential while the precursor ions are passing through the conductive box.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

FIGS. 5A and 5B are diagrams illustrating other examples of potentials on the potential lift, deceleration portion, collisional cell, and reacceleration portion.

FIG. 6 is a table showing one example of corresponding relationships among valence numbers of precursor ions, variable range of potentials on the potential lift, decelerating potential difference, and maximum collisional kinetic energy.

FIG. 8 is a table showing the specifications of the conventional TOF/TOF mass spectrometer shown in FIG. 7.

FIG. 9 is a table showing the range of mass-to-charge ratios of product ions and precursor ions in which the relation, kinetic energy per valence of product ions kinetic energy per valence of precursor ions, is satisfied.

DETAILED DESCRIPTION OF THE INVENTION

The preferred embodiments of the present invention are hereinafter described in detail with reference with the drawings. It is to be understood that the embodiments described below do not unduly restrict the content of the present invention set forth in the appended claims and that configurations described below are not always constituent components of the invention.

1. First Embodiment

1-1. Configuration

Figure 1:
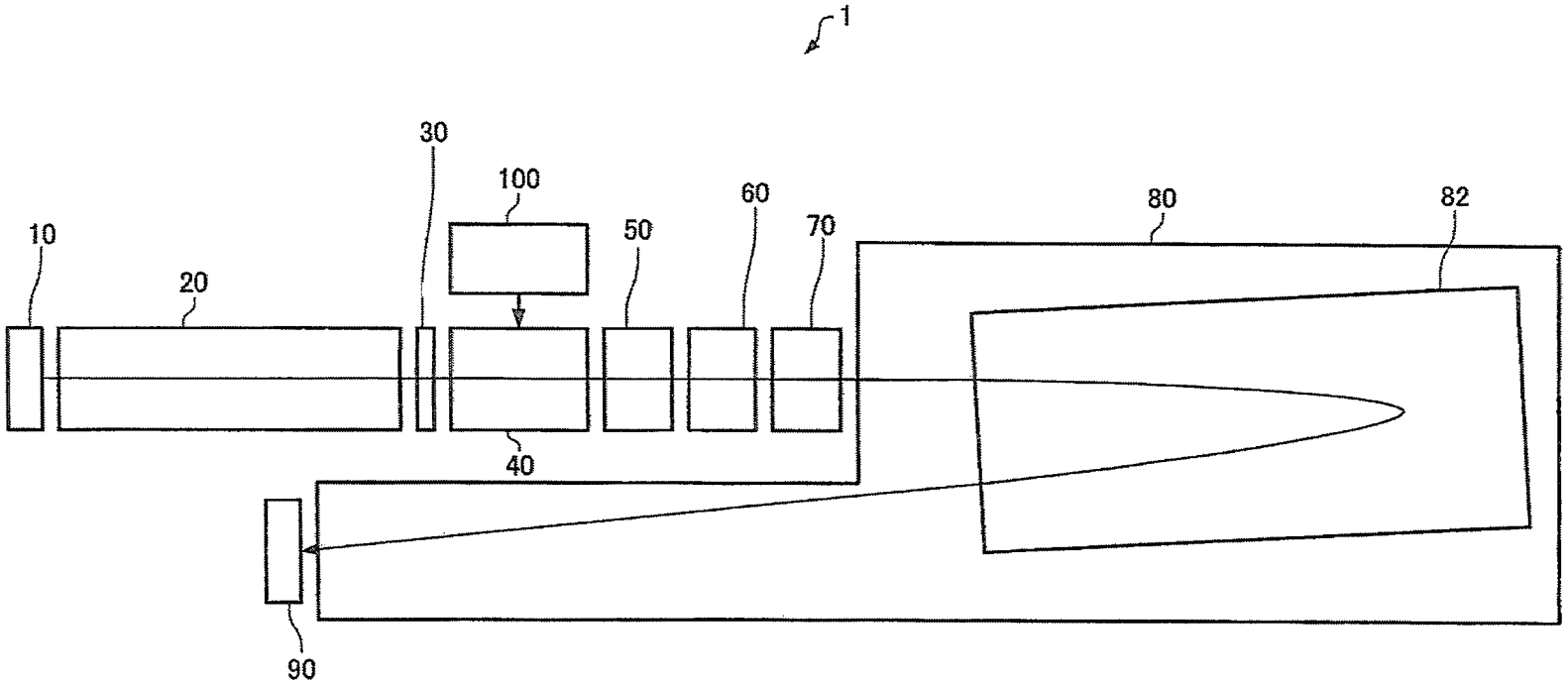
FIG. 1 is a diagram of a time-of-flight (TOF) mass spectrometer according to one embodiment of the present invention, showing the configuration of the spectrometer.

First, the configuration of a time-of-flight (TOF) mass spectrometer according to a first embodiment of the present invention is described by referring to FIG. 1.

As shown in FIG. 1, the TOF mass spectrometer of the present invention is generally indicated by reference numeral 1, and is configured including an ion source 10, a first mass analyzer 20, an ion gate 30, a potential lift 40, a deceleration portion 50, a collisional cell 60, a reacceleration portion 70, a second mass analyzer 80, a detector 90, and a potential control portion 100. Some constituent elements of the TOF mass spectrometer of the present invention may be omitted or modified. Alternatively, new constituent elements may be added to this TOF mass spectrometer.

The ion source 10 ionizes a sample by a given method. In the present embodiment, the ion source 10 mainly generates monovalent ions. One example of this ion source 10 utilizes a matrix-assisted laser desorption ionization (MALDI) method consisting of mixing and dissolving a matrix (liquid, crystalline compound, metal powder, or the like) for promoting ionization in a sample, solidifying the mixture, and irradiating the solidified mixture with laser radiation to ionize the sample.

The ions generated by the ion source 10 are accelerated by the potential difference (accelerating potential difference) $V_a$ between the ion source 10 and the first mass analyzer 20, enter the first mass analyzer 20, and travel through the first mass analyzer 20. Preferably, the accelerating potential difference $V_a$ is increased to a maximum to enhance the efficiency at which the ions generated by the ion source 10 are extracted.

The first mass analyzer 20 separates the various ions generated by the ion source 10 according to flight time corresponding to mass-to-charge ratio. In particular, the first mass analyzer 20 separates the various ions by making use of the fact that the flight time T differs according to mass-to-charge ratio m/z of ions as given by Eq. (3). The first mass analyzer 20 is set, for example, to ground potential (0 V). The various ions separated by the first mass analyzer 20 enter the ion gate 30.

The ion gate 30 selects ions of a desired mass-to-charge ratio as precursor ions from various ions separated by the first mass analyzer 20. For example, this is achieved by varying the potential on the ion gate 30 with time such that only ions of a desired mass-to-charge ratio travel straight through the ion gate 30. The precursor ions selected by the ion gate 30 enter the potential lift 40.

Figure 2:
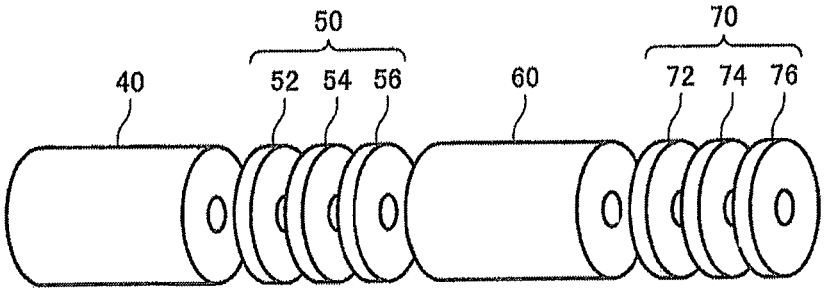
FIG. 2 is a perspective view of the potential lift, deceleration portion, collisional cell, and reacceleration portion included in the mass spectrometer shown in FIG. 1.

The potential lift 40 is a conductive box through which the precursor ions selected by the ion gate 30 pass. FIG. 2 is a perspective view of the potential lift 40, deceleration portion 50, collisional cell 60, and reacceleration portion 70, showing examples of their structures. As shown in FIG. 2, the potential lift 40 may be a cylindrical box containing a central space through which ions pass.

The potential control portion 100 controls the potential on the potential lift 40. In particular, when precursor ions enter the potential lift 40, the potential control portion 100 sets the potential on the potential lift 40 at a first potential of $V_1$. When the potential on the potential lift 40 is varied, the potential on the potential lift 40 is varied from $V_1$ to a second potential of $V_2$ while the precursor ions are passing through the potential lift 40. For example, the first potential $V_1$ is set at the same potential (e.g., ground potential (0 V)) as the potential on the first mass analyzer 20. The second potential $V_2$ is variable within a desired range such that $V_2-V_1$ is opposite in polarity to the precursor ions.

The flight time in which precursor ions travel through the first mass analyzer 20 is calculated using Eq. (3) from the mass-to-charge ratio m/z of the precursor ions and the accelerating potential difference of $V_a$. For instance, the flight time from the instant when precursor ions are generated in the ion source 10 to the instant when they enter the potential lift 40 can be calculated. For example, a table indicating the correspondence between the mass-to-charge ratio m/z of precursor ions and this flight time is previously stored in a memory (not shown). The potential control portion 100 refers to the table and modifies the potential on the potential lift 40 from $V_1$ to $V_2$ while precursor ions are passing through the potential lift 40.

As mentioned previously, the accelerating potential difference $V_a$ between the ion source 10 and the first mass analyzer 20 is preferably maximized to enhance the efficiency at which the ions generated by the ion source 10 are extracted. Accordingly, in the present embodiment, the accelerating potential difference $V_a$ is set to a maximum value, the ions are accelerated to the greatest extent, and then the potential on the potential lift 40 is varied from $V_1$ to $V_2$ to decelerate the precursor ions prior to entry into the collisional cell 60 by the potential difference between the potential lift 40 and the collisional cell 60.

If the precursor ions are positive ions, the potential control portion 100 decreases the potential on the potential lift 40 from $V_1$ to $V_2$. Conversely, if the precursor ions are negative ions, the potential control portion 100 increases the potential on the potential lift 40 from $V_1$ to $V_2$ to decelerate the precursor ions. For example, when the precursor ions enter the potential lift 40, the potential control portion 100 sets the potential on the potential lift 40 close to ground potential (0 V). If the precursor ions are positive ions during their travel through the potential lift 40, the potential control portion 100 reduces the potential on the potential lift 40 to a desired negative potential. If the precursor ions are negative ions, the potential control portion can increase the potential on the potential lift 40 to a desired positive potential.

In the present embodiment, the deceleration portion 50 is mounted between the potential lift 40 and the collisional cell 60. The precursor ions decelerate during their travel through the deceleration portion 50. As shown in FIG. 2, the deceleration portion 50, for example, consists of disklike electrodes 52, 54, and 56, each of which is centrally provided with a hole. The first stage of electrode 52 is set at the same potential (i.e., $V_2$) as the potential lift 40. The final stage of electrode 56 is set at the same potential as the collisional cell 60. The intermediate electrode 54 is set at an intermediate potential between the potential lift 40 and the collisional cell 60. Thus, the precursor ions can be decelerated. The position of the intermediate electrode 54 is so adjusted that the precursor ions are converged by the lens effect. The deceleration portion 50 may be replaced by a free space, in which case the precursor ions can be decelerated by the potential difference between the potential lift 40 and the collisional cell 60.

The collisional cell 60 fragments the precursor ions passed through both the potential lift 40 and the deceleration portion 50, thus generating various product ions. As shown in FIG. 2, the collisional cell 60 is the cylindrical box having the central space that permits passage of the precursor ions. The precursor ions collide against gas during their travel through the collisional cell 60 and thus fragment with a certain probability. As a result, various product ions are generated. For instance, the potential on the collisional cell 60 is set at the same potential (e.g., ground potential (0 V)) as the potential on the first mass analyzer 20. Precursor ions not fragmented in the collisional cell 60 and various product ions generated by the fragmentation of the precursor ions enter the reacceleration portion 70.

The reacceleration portion 70 is mounted between the collisional cell 60 and the second mass analyzer 80. The ions (i.e., unfragmented precursor ions passed through the collisional cell 60) leaving the collisional cell 60 and the various product ions generated in the collisional cell 60 are accelerated by the reacceleration portion 70 and enter the second mass analyzer 80. As shown in FIG. 2, the reacceleration portion 70, for example, consists of disklike electrodes 72, 74, and 76, each of which is centrally provided with a hole. The precursor ions can be reaccelerated by setting the first stage of electrode 72 at the same potential as the collisional cell 60, setting the final stage of electrode 76 at a desired reacceleration potential, and setting the intermediate electrode 74 at an intermediate potential between the potential on the collisional cell 60 and the reacceleration potential.

The second mass analyzer 80 separates the various ions according to flight time that varies depending on mass-to-charge ratio. In the present embodiment, the second mass analyzer 80 includes a reflectron field 82. The various ions entering the second mass analyzer 80 flight through the free space and then are pushed back by the reflectron field 82. The ions then travel through the free space and arrive at the detector 90.

The detector 90 outputs an analog signal in real time, the signal corresponding to the amount of incident ions (intensity).

In the present embodiment, the potential gradient in the reflectron field 82 is so set that a maximum kinetic energy per valence of ions that can be pushed back by the reflectron field 82 is substantially equal to the sum of the kinetic energy per valence given to ions by the accelerating potential difference between the ion source 10 and the first mass analyzer 20 and the kinetic energy per valence given to ions by reacceleration made by the reacceleration portion 70. Consequently, theoretically all ions entering the reflectron field 82 can be pushed back and passed to the detector 90.

Figure 3:
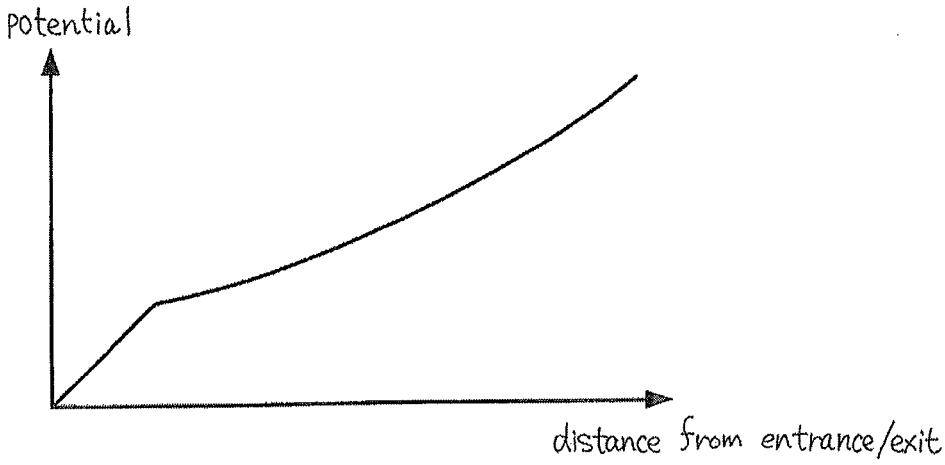
FIG. 3 is a graph showing one example of potential distribution in a reflectron field.

In order to vary the collisional energies of ions greatly, it is desired that the potential distribution of the reflectron field 82 have a parabolic portion such that the reflectron field 82 has large acceptance. For example, all the potential distribution in the reflectron field 82 may be parabolic. As shown in FIG. 3, the potential distribution of the reflectron field 82 may contain a linear portion and a parabolic portion. In the example of FIG. 3, the potential distribution of the reflectron field 82 has a linear portion near the ion entrance/exit and a parabolic portion remote from the ion entrance/exit. Consequently, some length of free space can be secured while maintaining some degree of kinetic energy focusing.

The reacceleration portion 70 is not essential. Since it is difficult to efficiently push back product ions of low kinetic energies at the reflectron field 82 and to observe them, it is important to add an appropriate degree of kinetic energy to the ions by the reacceleration portion 70 for obtaining some level of performance. Where the reacceleration portion 70 is not present, the potential gradient in the reflectron field 82 is so set that a maximum kinetic energy per valence of ions that can be pushed back at the reflectron field 82 is comparable to the kinetic energy per valence given to the ions by the accelerating potential difference between the ion source 10 and the first mass analyzer 20.

1-2. Operation

Figure 4A:
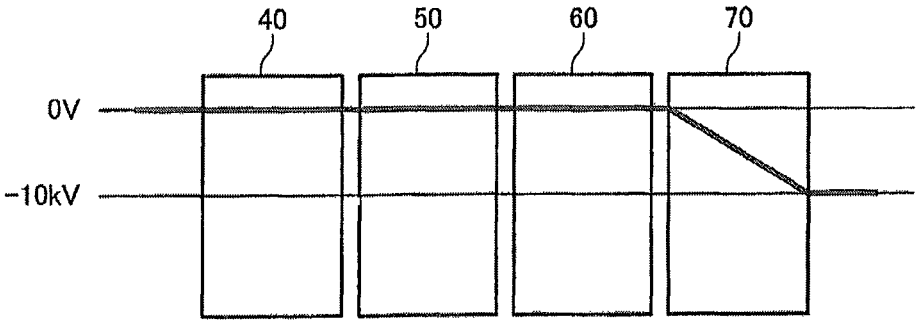
FIGS. 4A and 4B are diagrams illustrating examples of potentials on the potential lift, deceleration portion, collisional cell, and reacceleration portion.
Figure 4B:
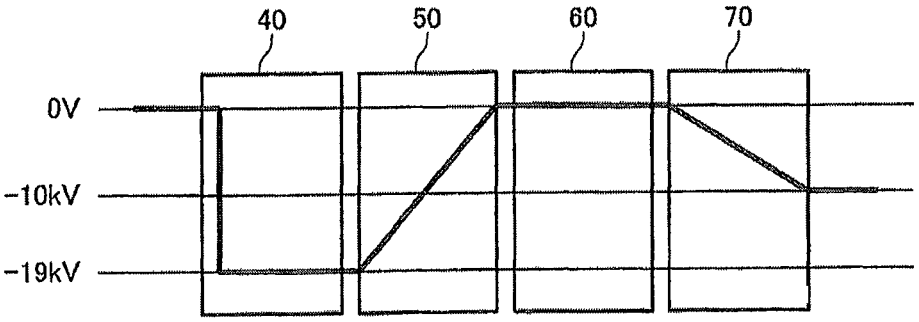
Figure 7:
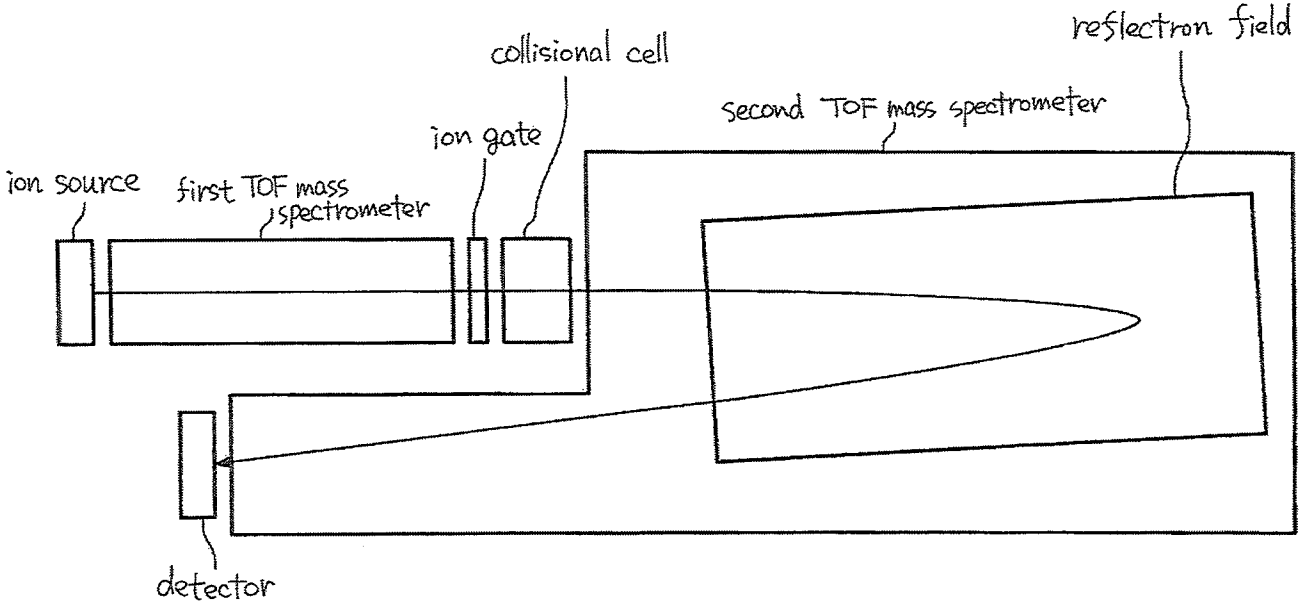
FIG. 7 is a diagram showing the configuration of one conventional TOF/TOF mass spectrometer.

Examples of the operation of the TOF mass spectrometer according to the first embodiment of the invention are next described in detail. FIGS. 4A and 4B show examples of potentials on the potential lift 40, deceleration portion 50, collisional cell 60, and reacceleration portion 70. In both examples of FIGS. 4A and 4B, the potentials on the first mass analyzer 20 and collisional cell 60 are kept at 0 V. Monovalent positive ions generated by the ion source 10 are accelerated by the accelerating potential difference 20 kV between the ion source 10 and the first mass analyzer 20, pass through the first mass analyzer 20, and are selected as precursor ions by the ion gate 30.

In the example of FIG. 4A, precursor ions are introduced into the collisional cell 60 with high energies. In this example, monovalent precursor ions are accelerated by the accelerating potential difference of 20 kV and enter the potential lift 40 with kinetic energy of 20 keV. If the ions are passed intact without operating the potential lift 40 (i.e., the potential is kept at 0 V), the precursor ions exit from the potential lift 40 while maintaining their kinetic energy of 20 keV. At this time, the potential on the potential lift 40 and the potential on the collisional cell 60 are 0 V. Therefore, the potential on the intervening deceleration portion 50 is also 0 V. Consequently, the precursor ions passed through the potential lift 40 pass into the collisional cell 60 while their kinetic energy is maintained at 20 keV without being decelerated in the deceleration portion 50.

FIG. 4B shows an example in which precursor ions are passed into the collisional cell 60 with low energies. In this example, monovalent precursor ions are accelerated by the accelerating potential difference of 20 kV and enter the potential lift 40 with kinetic energy of 20 keV. When the precursor ions stay in the potential lift 40, the potential on the potential lift 40 is varied from 0 V to −19 kV. Consequently, when the precursor ions exit from the potential lift 40, a potential difference of 19 kV is developed between the potential lift 40 and the collisional cell 60. If the potential on the electrode 52 of the deceleration portion 50 is changed so as to be equal to the potential (−19 kV) on the potential lift 40, the potential on the electrode 56 is varied to be equal to the potential (0 V) on the collisional cell 60, and the potential on the intermediate electrode 54 is changed to an intermediate potential (−9.5 kV) between the potential lift 40 and the collisional cell 60 simultaneously with variation of the potential on the potential lift 40, the precursor ions exiting from the potential lift 40 are decelerated by the deceleration portion 50 and introduced into the collisional cell 60. As a result, the kinetic energy of monovalent precursor ions which was 20 keV on entering the potential lift 40 drops to 1 keV on entering the collisional cell 60.

As can be seen from the examples of FIGS. 4A and 4B, if the potential on the potential lift 40 is varied within a range from −20 kV to 0 V, the collisional energy of monovalent precursor ions can be varied in a range from 0 to 20 keV according to the potential. More generally, the potential control portion 100 can cause monovalent precursor ions to enter the collisional cell 60 while varying their kinetic energy (collisional energy) by varying the potential $V_2$ in such a way that the difference in absolute value between the potential $V_2$ on the potential lift 40 on exiting from the potential lift 40 and the potential on the collisional cell 60 lies between 0 and $V_a$.

The kinetic energy of product ions generated from precursor ions of 20 keV is equal to or less than 20 keV. Accordingly, by varying the potential on the potential lift 40 within a range from −20 kV to 0 V, the maximum kinetic energy (20 keV) of ions entering the reacceleration portion 70 can be brought to below the sum (less than 30 keV) of the kinetic energy of 20 keV per valence given to the ions by the accelerating potential difference of 20 kV and the kinetic energy of 10 keV per valence given to the ions by the reacceleration portion 70. Consequently, all the ions entering the reflectron field 82 can be pushed back and reach the detector 90 by setting the potential gradient in the reflectron field such that the maximum kinetic energy per valence of ions that can be pushed back by the reflectron field 82 is 30 keV.

In the examples of FIGS. 4A and 4B, the precursor ions are positive ions. Where the precursor ions are negative ions, the potential polarity may be reversed with respect to the polarity in the examples of FIGS. 4A and 4B.

As described so far, according to the TOF mass spectrometer of the first embodiment, the kinetic energy of precursor ions entering the collisional cell 60 can be varied greatly by varying the potential on the potential lift 40 from $V_1$ to $V_2$ while the precursor ions selected by the ion gate 30 are traveling through the potential lift 40. Consequently, according to the TOF mass spectrometer of the present embodiment, the variable range of collisional energies of precursor ions can be made wider than heretofore.

2. Second Embodiment

2-1. Configuration

Since the TOF mass spectrometer of the second embodiment is similar in configuration (FIG. 1) with the spectrometer of the first embodiment, the configuration is omitted from being shown. The difference is that in the TOF mass spectrometer 1 of the second embodiment, the potential control portion 100 controls the potential on the potential lift 40 while taking account of cases in which bivalent and multivalent ions are selected as precursor ions.

In the present embodiment, the ion source 10 produces multivalent ions as well as monovalent ions. One example of this ion source 10 is an ESI ion source. Furthermore, some MALDI ion sources produce multivalent ions.

The first mass analyzer 20, ion gate 30, and potential lift 40 of the present embodiment are similar in configuration with their counterparts of the first embodiment and so their description is omitted.

The potential control portion 100 of the present embodiment controls the potential on the potential lift 40 according to valence number z of precursor ions. In particular, when precursor ions enter the potential lift 40, the potential control portion 100 sets the potential on the potential lift 40 at the first potential $V_1$ corresponding to the valence number z of the precursor ions. When the potential on the potential lift 40 is varied, this potential is varied from $V_1$ to a second potential of $V_2$ according to the valence number z of the precursor ions during their travel through the potential lift 40. For instance, the first potential $V_1$ is set at the same potential (e.g., ground potential (0 V)) as the potential on the first mass analyzer 20. The second potential $V_2$ is set to be variable within a desired range such that $V_2-V_1$ is opposite in polarity to the precursor ions.

Since the deceleration portion 50, collisional cell 60, reacceleration portion 70, second mass analyzer 80, and detector 90 are similar in configuration with their counterparts of the first embodiment, their description is omitted.

2-2. Operation

The operation of the TOF mass spectrometer of the second embodiment is next described in detail while taking their examples. FIGS. 5A and 5B show examples of potentials on the potential lift 40, deceleration portion 50, collisional cell 60, and reacceleration portion 70. In both examples of FIGS. 5A and 5B, the potential on the first mass analyzer 20 and the potential on the collisional cell 60 are kept at 0 V. Bivalent positive ions generated by the ion source 10 are accelerated by the accelerating potential difference of 20 kV between the ion source 10 and the first mass analyzer 20, pass through the first mass analyzer 20, and are selected as precursor ions by the ion gate 30.

In the example of FIG. 5A, precursor ions are introduced into the collisional cell 60 with high energies. In this example, bivalent precursor ions are accelerated by an accelerating potential difference of 20 kV and enter the potential lift 40 with kinetic energy of 40 keV. When the precursor ions stay in the potential lift 40, the potential on the potential lift 40 is varied from 0 V to −10 kV. Consequently, when the precursor ions exit from the potential lift 40, a potential difference of 10 kV is developed between the potential lift 40 and the collisional cell 60. If the potential on the electrode 52 of the deceleration portion 50 is varied so as to be equal to the potential (−10 kV) on the potential lift 40, the potential on the electrode 56 is varied to the same potential (0 V) as the collisional cell 60, and the potential on the intermediate electrode 54 is varied to an intermediate potential of −5 kV between the potential lift 40 and the collisional cell 60 simultaneously with variation of the potential on the potential lift 40, then the precursor ions exiting from the potential lift 40 are decelerated by the deceleration portion 50 and introduced into the collisional cell 60. As a result, the kinetic energy of the bivalent precursor ions which was 40 keV on entering the potential lift 40 drops to 20 keV on entering the collisional cell 60.

FIG. 5B shows an example in which precursor ions are introduced into the collisional cell 60 with low energies. In this example, bivalent precursor ions are accelerated by an accelerating potential difference of 20 kV and enter the potential lift 40 with kinetic energy of 40 keV. When the precursor ions stay in the potential lift 40, the potential on the potential lift 40 is varied from 0 V to −19.5 kV. As a consequence, when the precursor ions exit from the potential lift 40, a potential difference of 19.5 kV is developed between the potential lift 40 and the collisional cell 60. If the electrode 52 of the deceleration portion 50 and the potential lift 40 are made equipotential (−19.5 kV), the electrode 56 and the collisional cell 60 are made equipotential (0 V), and the potential on the intermediate electrode 54 is varied to an intermediate potential of −9.75 kV between the potential lift 40 and the collisional cell 60 simultaneously with variation of the potential on the potential lift 40, then precursor ions exiting from the potential lift 40 are decelerated by the deceleration portion 50 and introduced into the collisional cell 60. As a result, the kinetic energy of bivalent precursor ions which was 40 keV on entering the potential lift 40 decreases to 10 keV on entering the collisional cell 60.

As can be seen from the examples of FIGS. 5A and 5B, the collisional energy of bivalent precursor ions can be varied within a range from 0 to 20 keV according to the potential on the potential lift 40 by varying this potential within a range from −10 kV to 0 V. Product ions generated from precursor ions of 20 keV have kinetic energies of 20 keV or less. Accordingly, the maximum kinetic energy (20 keV) of ions entering the reacceleration portion 70 can be brought into coincidence with the kinetic energy of 20 keV per valence given to the ions by the accelerating potential difference of 20 kV if the potential on the potential lift 40 is varied within the range from −10 kV to 0 V. As a result, the kinetic energy of ions entering the second mass analyzer 80 is equal to or less than the sum (30 keV) of the kinetic energy of 20 keV per valence given to the ions by the accelerating potential difference of 20 kV between the ion source 10 and the first mass analyzer 20 and the kinetic energy of 10 keV per valence given to the ions by the reacceleration portion 70. Hence, all the ions entering the reflectron field 82 can be pushed back and reach the detector 90 by setting the potential gradient in the reflectron field such that the maximum kinetic energy per valence of ions that can be pushed back by the reflectron field 82 is 30 keV.

FIG. 6 is a table listing the variable range of potentials on the potential lift 40 in which the kinetic energies of product ions generated from bivalent, trivalent, and quadrivalent precursor ions accelerated with 20 kV are distributed from 0 to 20 keV (i.e., less than the kinetic energy given per valence to the ions by the accelerating potential difference of 20 kV), the decelerating potential difference, and maximum collisional kinetic energy (converted into monovalence). Where precursor ions are multivalent, if generated product ions are smaller in valence number than the precursor ions, the kinetic energies per valence are distributed over a wider range. Therefore, greater deceleration must be achieved in the deceleration portion 50 compared with the case of monovalent precursor ions. For this reason, collisional energies converted into monovalence are smaller.

A generalization of the table of FIG. 6 shows that the kinetic energy of ions entering the reacceleration portion 70 can be made less than the kinetic energy of $eV_a$ per valence given to the ions by the accelerating potential difference $V_a$ by setting the second potential $V_2$ by the potential control portion 100 such that the difference in absolute value between the potential $V_2$ on the potential lift 40 when precursor ions of valence number z exit from the potential lift 40 and the potential on the collisional cell 60 varies within a range from $V_a \times (1-1/z)$ to $V_a$. Accordingly, all the ions can be pushed back and reach the detector 90 by setting the potential gradient in the reflectron field 82 such that ions having kinetic energies that are equal to or less than the sum of the kinetic energy $eV_a$ per valence given to the ions by the accelerating potential difference $V_a$ and the kinetic energy per valence given to the ions by the reacceleration portion 70 can be pushed back.

In the examples of FIGS. 5A and 5B, the precursor ions are positive ions. Where the precursor ions are negative ions, the potential may be reversed in polarity with respect to the cases of FIGS. 5A and 5B.

As described so far, according to the TOF mass spectrometer of the second embodiment, the kinetic energy of precursor ions on entering the collisional cell 60 can be varied greatly by varying the potential on the potential lift 40 from $V_1$ to $V_2$ while the precursor ions selected by the ion gate 30 are traveling through the potential lift 40. Hence, according to the TOF mass spectrometer of the present embodiment, the variable range of collisional energies of the precursor ions can be made wider than conventional.

Furthermore, according to the TOF mass spectrometer of the second embodiment, all the ions entering the second mass analyzer 80 can be pushed back by the reflectron field 82 and reach the detector 90 by restricting the variable range of the potential on the potential lift 40 according to the valence number of the precursor ions. Accordingly, the TOF mass spectrometer of the present embodiment makes it possible to observe fragmentations of multivalent ions efficiently. The present invention is not restricted to the present embodiment but rather may be variously modified in implementing the embodiment within the scope of the present invention.

It is to be understood that the above-described embodiments are merely exemplary and that the invention is not restricted to them. For example, the embodiments may be combined appropriately.

The present invention embraces configurations substantially identical (e.g., in function, method, and results or in purpose and advantageous effects) with the configurations described in the preferred embodiments of the invention. Furthermore, the invention embraces the configurations described in the embodiments including portions which have replaced non-essential portions. In addition, the invention embraces configurations which produce the same advantageous effects as those produced by the configurations described in the preferred embodiments or which can achieve the same objects as the objects of the configurations described in the preferred embodiments. Further, the invention embraces configurations which are the same as the configurations described in the preferred embodiments and to which well-known techniques have been added.

What is claimed is:

1. A time-of-flight mass spectrometer comprising:

an ion source for ionizing a sample to thereby produce precursor ions of valence z accelerated through potential $V_a$;

a first mass analyzer for separating the produced ions according to flight time corresponding to mass-to-charge ratio;

an ion gate for selecting precursor ions from ions separated and selected by the first mass analyzer;

a conductive box through which the precursor ions selected by the ion gate pass;

a collisional cell for fragmenting the precursor ions passed through the conductive box into product ions having valences equal or less than z;

a second mass analyzer containing a reflectron field for separating the precursor ions passed through the collisional cell and the product ions generated in the collisional cell according to flight time corresponding to mass-to-charge ratio;

a detector for detecting ions separated by the second mass analyzer; and a potential control portion for controlling the electric potential on the conductive box;

wherein, when the precursor ions are introduced into the conductive box, the potential control portion sets the potential on the conductive box at a first potential $V_1$;

wherein, the potential on the conductive box is varied, from the first potential $V_1$ to a second potential $V_2$ while the precursor ions stay in and are passing through the conductive box and wherein, when the potential on the conductive box is varied, the potential control portion varies the potential from the first potential $V_1$ to the second potential $V_2$ to decelerate the precursor ions between the conductive box and the collisional cell by the potential difference between the conductive box and the collisional cell;

wherein said potential control portion sets said second potential $V_2$ within a range in which the difference in absolute value between the second potential $V_2$ and the potential on the collisional cell is between $V_a \times (1-1/z)$ and $V_a$, where z is the valence number of the precursor ions and $V_a$ is the accelerating potential difference between the ion source and the first mass analyzer; and wherein a maximum kinetic energy per valence of ions capable of being pushed back by the reflectron field is comparable to the kinetic energy per valence given to ions by the accelerating potential difference between said ion source and said first mass analyzer.

2. A time-of-flight mass spectrometer as set forth in claim 1, wherein said first potential is the same as the potential on said first mass analyzer.

3. A time-of-flight mass spectrometer as set forth in claim 1, wherein the potential on said collisional cell is the same as the potential on said first mass analyzer.

4. A time-of-flight mass spectrometer as set forth in claim 1, wherein said potential control portion varies a set range of said second potential according to valence numbers of the precursor ions.

5. A time-of-flight mass spectrometer as set forth in claim 1, wherein a reacceleration portion for reaccelerating ions is mounted between said collisional cell and said second mass analyzer.

6. A time-of-flight mass spectrometer as set forth in claim 5, wherein said second mass analyzer contains a reflectron field, and wherein a maximum kinetic energy per valence of ions capable of being pushed back by the reflectron field is comparable to the sum of the kinetic energy per valence given to ions by the accelerating potential difference between the ion source and the first mass analyzer and the kinetic energy per valence given to ions by reacceleration made by the reacceleration portion.

7. A time-of-flight mass spectrometer as set forth in claim 1, wherein said reflectron field has a potential distribution that contains a parabolic portion.

8. A time-of-flight mass spectrometer as set forth in claim 1, wherein said collisional cell and said first mass analyzer are at ground potential.

9. A method of controlling a time-of-flight mass spectrometer having: an ion source for ionizing a sample to thereby produce precursor ions of valence z and accelerated through a potential $V_a$; a first mass analyzer for separating the produced ions according to flight time corresponding to mass-to-charge ratio; an ion gate for selecting precursor ions from ions separated and selected by the first mass analyzer; a conductive box through which the precursor ions selected by the ion gate pass; a collisional cell for fragmenting the precursor ions having a valence equal or less than z passed through the conductive box into product ions; a second mass analyzer having a reflectron field for separating the precursor ions passed through the collisional cell and the product ions generated in the collisional cell according to flight time corresponding to mass-to-charge ratio; and a detector for detecting ions separated by the second mass analyzer, said method comprising the steps of:

setting the potential on the conductive box at a first potential when the precursor ions are introduced into the conductive box; and varying the potential on the conductive box from the first potential $V_1$ to a second potential $V_2$ while the precursor ions stay in and are passing through the conductive box when the potential on the conductive box is varied and wherein, when the potential on the conductive box is varied, the potential control portion varies the potential from the first potential $V_1$ to the second potential $V_2$ to decelerate the precursor ions between the conductive box and the collisional cell by the potential difference between the conductive box and the collisional cell, said second potential being within a range in which the difference in absolute value between the second potential $V_2$ and the potential on the collisional cell is between $V_a \times (1-1/z)$ and $V_a$, where z is the valence number of the precursor ions and $V_a$ is the accelerating potential difference between the ion source and the first mass analyzer, and the maximum kinetic energy per valence of ions capable of being pushed back by the reflectron field is comparable to the kinetic energy per valence given to ions by the accelerating potential difference between said ion source and said first mass analyzer.

* * * * *